United States Patent [19]

Sleishman

[11] 4,295,405

[45] Oct. 20, 1981

[54] MUSICIAN'S DRUM

[76] Inventor: Donald E. Sleishman, 56A Bignell St., Illawong, New South Wales, 2234, Australia

[21] Appl. No.: 82,462

[22] Filed: Oct. 9, 1979

[30] Foreign Application Priority Data

Oct. 18, 1978 [AU] Australia ..... PD6446

[51] Int. Cl.[3] ..... G10D 13/02

[52] U.S. Cl. ..... 84/413; 84/411 R

[58] Field of Search ..... 84/411–420

[56] References Cited

U.S. PATENT DOCUMENTS

| | | | |
|---|---|---|---|
| 151,797 | 6/1874 | Rawson | 84/411 R |
| 388,806 | 8/1888 | Zoeller | 84/411 R |
| 504,910 | 9/1893 | Cox | 84/411 R |
| 775,711 | 11/1904 | Turney | 84/411 R |
| 899,488 | 9/1908 | Hemberger | 84/411 R |
| 1,254,756 | 1/1918 | Wilson | 84/411 R |
| 1,609,940 | 12/1926 | Geisler | 84/411 R |
| 2,331,096 | 10/1943 | Strupe | 84/411 R |
| 2,706,925 | 4/1955 | Fendlason | 84/413 |
| 3,376,777 | 4/1968 | Becker-Ehmck | 84/419 |
| 4,154,136 | 5/1979 | McIntyre | 84/411 A |

*Primary Examiner*—Lawrence R. Franklin

*Attorney, Agent, or Firm*—LeBlanc, Nolan, Shur & Nies

[57] ABSTRACT

A musician's drum wherein the diaphragms are tensioned by loading means extending from the diaphragm to a ring which is co-axial of the drum cylinder and is supported clear of the cylinder (shell) by struts extending to abutments near one end of the cylinder.

8 Claims, 8 Drawing Figures

MUSICIAN'S DRUM

BACKGROUND OF THE INVENTION

This invention relates to musician's drums.

Typically, a modern day drum, comprises an open-ended cylindrical shell either of metal or, in the larger sizes, of wood and two vellum or plastics diaphragms stretched across each end of the shell.

Usually each diaphragm is furnished with a stiff enlarged rim permanently secured to the main sheet of the diaphragm. The inner diameter of the diaphragm rim is slightly larger than the outer diameter of the shell and each diaphragm is held in place on the shell by means of a clamping ring structure which rests upon the rim of the diaphragm and is loaded in the axial direction of the shell by means of a plurality of tensioning devices extending from the clamping ring structure to anchorages secured to the outside of the shell.

Typically, those anchorages comprise metal blocks bolted to the shell intermediate its ends. In relatively shallow drums, there may be one ring of anchorages at the mid-height centre of the shell with tensioning screws extending in both directions from each anchorage to each clamping ring structure. In deeper drums it is more usual for there to be two rows of anchorages, one row associated with one diaphragm and the other row associated with the other diaphragm.

It must be remembered that it is usual for the tension in one diaphragm to be different from that in the other. Therefore the tension in the tensioning screw for the respective diaphragms do not counter-balance each other and thus there is a need for rigid securement of the anchorages to the shell even in those instances in which a single row of anchorages is utilized.

The primary source of noise from a drum is of course the vibration of the diaphragms, one as a result of it being struck by the drumstick or the like and the other as a result of sympathetic induced vibration, but the present invention springs from the discovery that the shell in most cases is also capable of resonant vibration and can add materially to the tone and output of the drum if it is free to vibrate. In the typical prior art drum described above the vibration of the shell is minimized or damped by virtue of the heavy metal block anchorages secured to the shell and the fact that those anchorages are held quite firmly in place relative to the shell ends by the tensioning screws.

SUMMARY OF THE INVENTION

The present invention has as a primary object the provision of a novel drum whereof the shell is largely unconstrained by the diaphragm loading means and is left free to vibrate.

The invention achieves that object by providing a musicians' drum of the kind having a cylindrical shell, at least one diaphragm, and loading means to engage and stretch the diaphragm across one end of the shell. The loading means includes engaging means gripping the periphery of the diaphragm, a stabilizer ring co-axial with the shell intermediate the ends of the shell and spaced apart from the shell, at least three abutment means extending from ring into abutment with the shell to prevent movement of the ring towards the one end of the shell, and a plurality of tensioning means extending from the diaphragm engaging means to the stabilizer ring.

By way of example several embodiments of the above described invention are described hereinafter with reference to the accompanying drawings.

Figure 1:
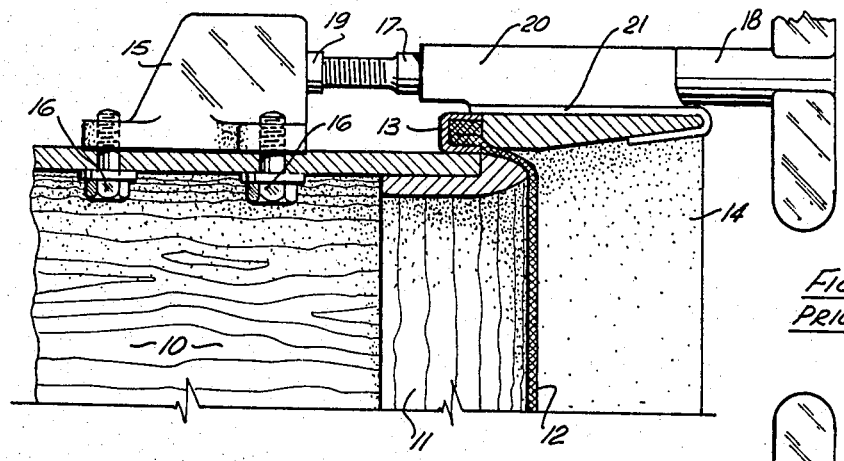
FIG. 1 PRIOR ART
FIG. 1 is a cross-sectional view of a rim portion of a drum shell and diaphragm tensioning means, being illustrative of the prior art.

FIG. 1 illustrates a typical bass drum in accordance with the prior art. Such a drum comprises a shell which itself comprises an open-ended wooden cylinder 10 with a smoothly faired but relatively sharp ended nosing 11 adhered thereto. The drum also comprises a diaphragm 12 with a permanently affixed peripheral rim 13. The drum further includes a ring structure comprising a wooden ring 14 adapted at one edge to bear against the diaphragm rim 13 and a plurality of abutment sleeves 20 with integral hook flanges 21 positioned at equally spaced intervals about the periphery of the ring 14.

The ring 14 is loaded against the diaphragm rim 13 to a greater or lesser extent to tension the diaphragm 12 by loading means comprising a plurality of tension means each consisting of a bolt 17 with a wing head 18. The shank of the bolt 17 extends through the sleeve 20 and the head 18 abuts one end of the sleeve 20.

The tension in the bolt 17 is transferred to the shell by an anchorage block 15, bolts 16 securing that block directly to the shell some distance from the nosing 11 and a nut 19 trapped by the block 15.

Figure 2:
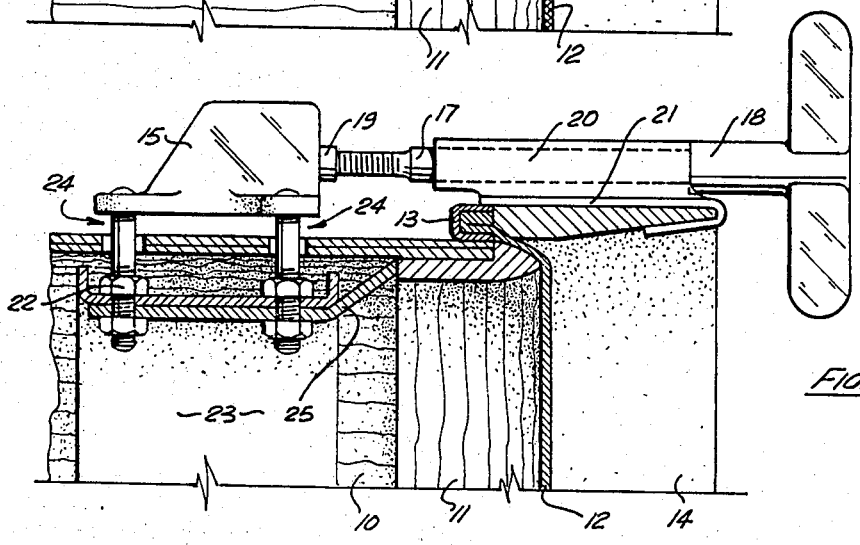
FIG. 2 is a view similar to FIG. 1 of an embodiment of the invention.

Turning now to FIG. 2, which illustrates a base drum embodying the present invention, it will be seen that the shell, ring structure and tension means are substantially in accordance with the prior art. However the diaphragm loading means in this case includes a stabilishing ring 23 within the shell of the drum and spaced therefrom to which the block 15 is secured by elongated studs 22. The studs 22 extend through clearance holes in the shell somewhat larger in diameter than the studs so that the studs make no direct contact with the shell.

The stabilising ring 23 is also secured by the respective sets of studs 22 to a plurality of plate-like struts 25 with their free ends abutting the axially inner edge face of the nosing 11.

Thus in accordance with the invention the only direct contact between the shell and the loading means are at the areas of abutment between the struts 25 and the nosing 11.

In the embodiment of the invention now being described the various tensioning means are united by the stabilising ring 23 which supports a plurality of structs 25 and a plurality of blocks 15. The number of struts 25 need not necessarily equal the number of blocks 15 but in each case the blocks and struts are equally spaced apart about the circumference of the shell.

Figure 3:
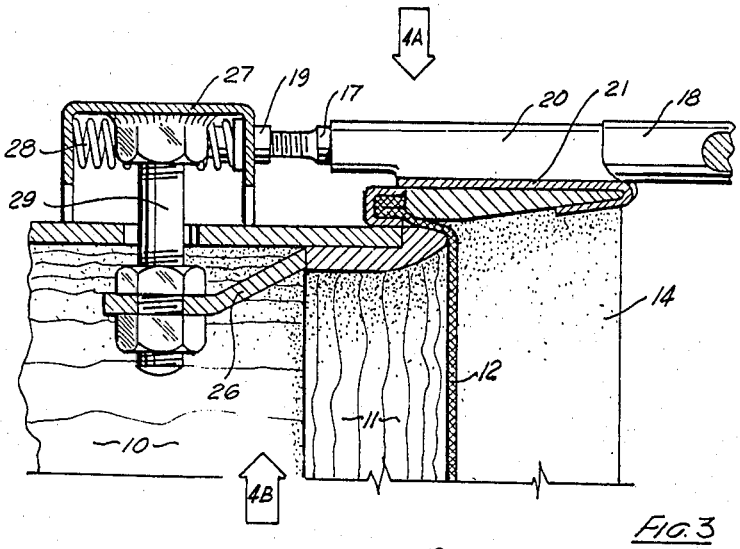
FIG. 3 is a view similar to FIG. 1 of still another embodiment of the invention.

FIG. 3 discloses an alternative high quality arrangement wherein the tensioning means comprise a bolt 17 and the abutment means comprise a strut 26 similar in function to the corresponding components of the FIG. 2 embodiment.

In this case however the blocks 15 are dispensed with and in the place of such blocks there is provided a channel-sectioned, metal external stabilising ring 27 encircling the shell and housing nuts 19. Each nut 19 is held in place by virtue of a compression spring 28. The stabilising ring 27 is secured firmly to each strut 26 by a substantial bolt 29 welded to the ring and extending to the associated strut 26 through a clearance hole in the shell 10.

Figure 5:
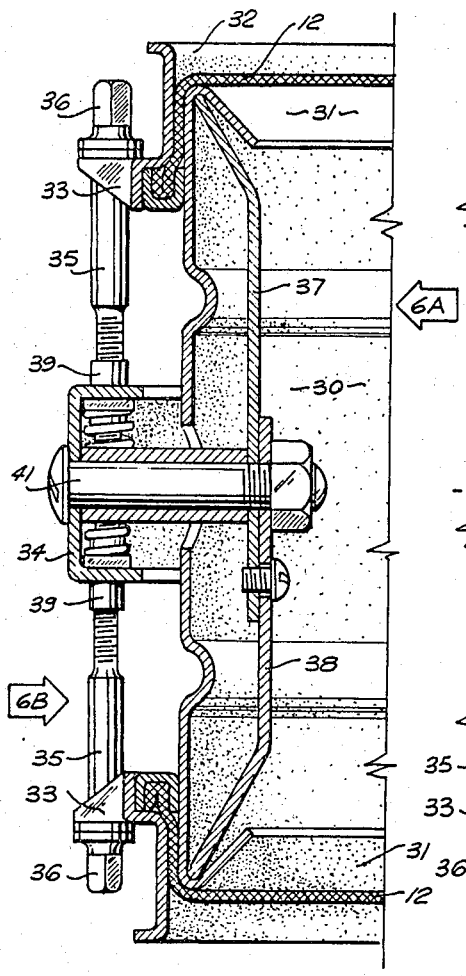
FIG. 5 is a view similar to FIG. 1 but extending for the full depth of the drum from one end to the other of still another embodiment of the invention.
Figure 6:
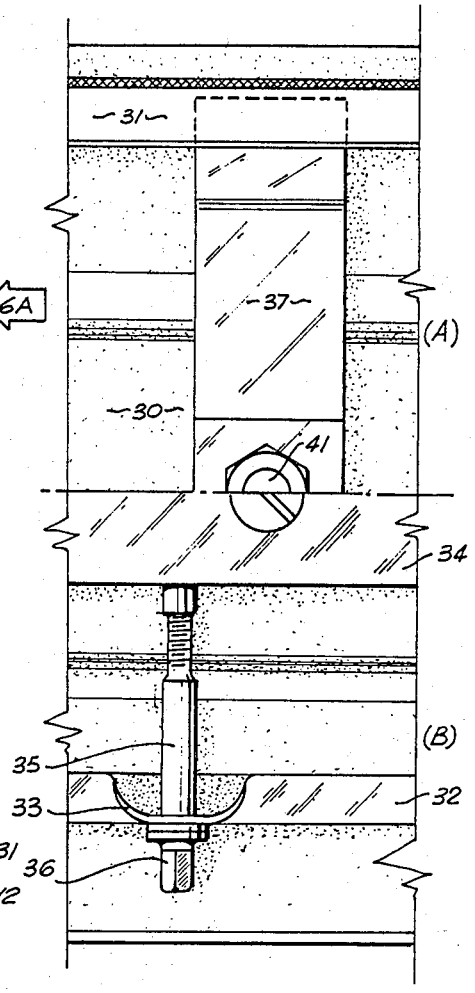
FIG. 6 is a side elevation illustrating at A and B the FIG. 5 embodiment when viewed in the respective directions of the arrows 6A and 6B appearing in FIG. 5.

The embodiment of the invention illustrated in FIGS. 5 and 6 shows it as applied to a snare drum. Such a drum is relatively shallow and its shell and ring structure are usually metal pressings. Thus as may be seen the shell 30 of the drum is of unitary metal construction with returned end flanges 31 providing a profile for the abutment with the diaphragms 32 similar to the profile provided by the nosing 11 of the earlier described bass drums. Likewise the drum ring structure is a metal pressing 32 with integrally formed brackets 33 equivalent in function to the sleeve and hook flange devices 20 and 21.

Figure 4:
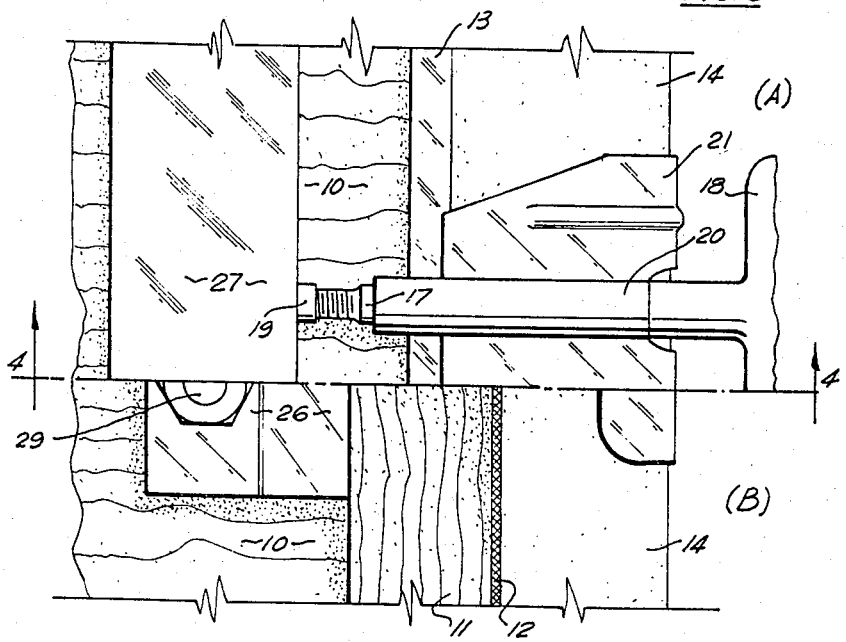
FIG. 4 is a composite view showing at A and B the embodiment of FIG. 3 when viewed in the respective directions of the arrows 4A and 4B appearing in that figure.

The loading arrangements according to this embodiment of the invention are similar to those of the FIGS. 3 and 4 embodiment but because the drum is so shallow a single external stabilising ring 34 corresponding to ring 27 of the earlier described embodiment is shared, as it were, by the tensioning means for the two diaphragms. Thus in respect of each diaphragm the tensioning means comprise a bolt 35 having a squared end 36 for engagement with a spanner or key and the abutment means comprise one or other of struts 37 and 38. If desired the struts 37 and 38 may be made as a one piece item from single strap of metal.

The bolts 35 engage nuts 39. A sleeve 40 and a clamping bolt 41 secures the ring 34 and the struts 37 and 38 firmly together. There is no contact between the sleeve 40 and the shell.

Figure 7:
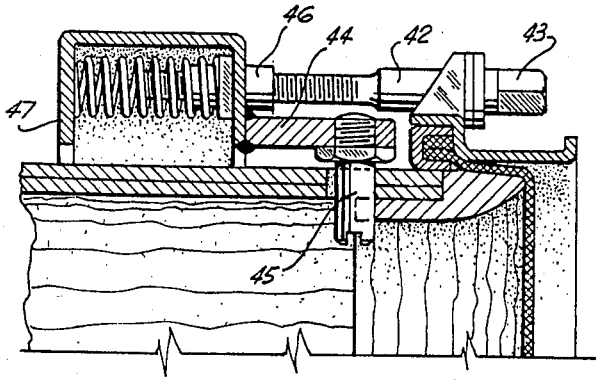
FIG. 7 is a view similar to FIG. 1 of still another embodiment of the invention.

The FIG. 7 embodiment of the invention shows are it as applied to a tom-tom. In effect tom-toms are similar to a smaller version of a bass drum, being of a diameter approaching that of a snare drum and of a depth about twice that of a snare drum. Thus for preference the amalgamation of the loading means utilized in relation to the snare drum is avoided and each of those loading means is independent from the other.

The loading means for each diaphragm comprise tensioning means in the form of a bolt 42 with a squared end 43.

The abutment means comprise a strut 44 with a pin 45 extending from it through a clearance hole in the drum shell so as to make substantially line contact with the rear edge of the shell nosing.

A nut 46 is mounted on an external stabilising ring 47 encircling the shell and spaced therefrom and which of course unites the various tensioning means around the periphery of the drum.

Figure 8:
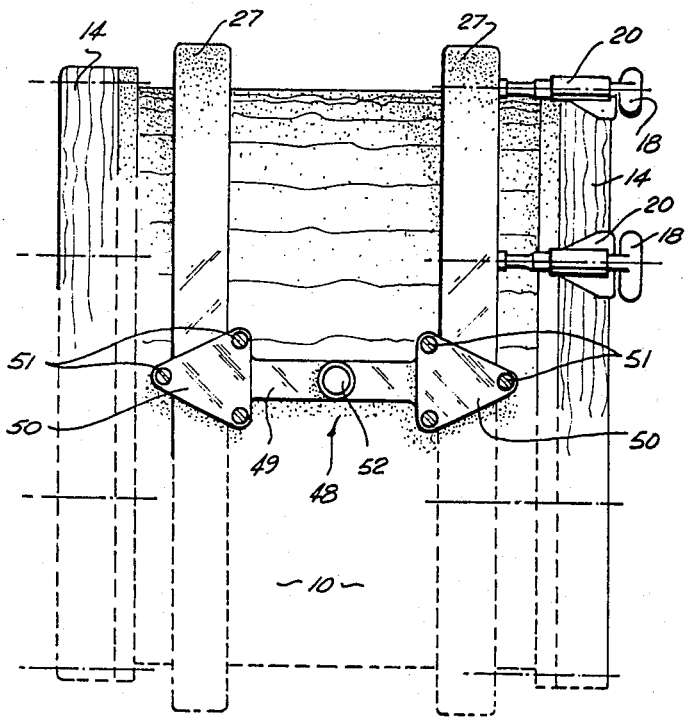
FIG. 8 is an elevation of a drum according to the FIG. 3 embodiment of the invention showing an adjustable supporting fixture thereon.

FIG. 8 depicts the outside view of a bass drum having diaphragm loading means the same as those illustrated in FIG. 3.

FIG. 8 also illustrates a supporting fitment for the drum or a fitment which may be used to support another instrument. That fitment comprises a bridge piece 48 in the form of a strap 49 with enlarged triangular end pieces 50. The bridge piece is secured to the stabilizing rings 27 by means of three clamping bolts 51 associated with each end piece 50 and triangular clamping plates, not shown, in alignment with each end piece 50 but disposed between the respective stabilizing rings 27 and the shell of the drum.

The bridge piece 48 has a socket 52 welded or otherwise secured to it which may be used to accept the end of a tripod mast for the support of the drum or as a support for the foot of a mast supporting for example a cymbal, music stand, or other item of drummer's apparatus.

I claim:

1. A musician's drum of the kind comprising a cylindrical shell, a diaphragm, and loading means to stretch the diaphragm across one end of the shell, wherein said loading means comprise: engaging means gripping the periphery of the diaphragm; a stabilizer ring co-axial with the shell intermediate the ends of the shell and spaced from the shell; at least three abutment means spaced apart around, secured to and extending from said ring into abutment with said shell to prevent movement of said ring towards at least said one end of the shell; and a plurality of tensioning means extending from said engaging means to said ring.

2. A drum according to claim 1, wherein said ring is external of the shell and wherein each said abutment means comprises a pin projecting from the ring through a hole in the shell having a diameter larger than that of the pin so that there is a substantially line contact between the pin and the shell.

3. A drum according to claim 1, including a step in the internal surface of the shell near said one end thereof, and wherein each said abutment means comprises: a stud extending through a hole in said shell; said hole being of greater diameter than that of the stud to avoid contact between said stud and said shell; and a strut internal of the shell, connected to and extending from the said stud to said step.

4. A drum according to claim 1, including a step in the internal surface of the shell near said one end thereof, wherein said ring is internal of the shell, and wherein each said abutment means comprises: a strut extending from the ring to said step; and wherein each said tensioning means extends from the engaging means to an anchorage block supported from said ring by at least one stud extending from the ring to the block through a hole in the shell of sufficiently larger diameter than the stud that there is no contact between said stud and said shell.

5. A drum according to claims 1, 2, or 3, having a supporting fitment for the support of the drum itself secured to said stabilizer ring.

6. A drum according to claims 1, 2 or 3, having a fitment for the support of another item of musical equipment by the drum secured to said stabilizer ring.

7. A drum according to any one of claims 1, 2, 3 or 4 wherein there are two diaphragms, one at each end of the shell and wherein loading means are provided for each diaphragm and include a common stabilizing ring.

8. A drum according to any one of claims 1, 2, 3 or 4 wherein there are two diaphragms, one at each end of the shell and wherein loading means are provided for each diaphragm and each loading means includes its associated stabilizing ring.

* * * * *